US005964003A

United States Patent [19]

Rogers

[11] Patent Number: 5,964,003

[45] Date of Patent: Oct. 12, 1999

[54] SCRUBBER

[76] Inventor: Gregory K. Rogers, 5233 Ragan Dr., The Colony, Tex. 75056-1238

[21] Appl. No.: 09/009,850

[22] Filed: Jan. 21, 1998

[51] Int. Cl.[6] ..... A46B 13/04

[52] U.S. Cl. ..... 15/98; 15/97.1; 15/29; 15/28; 15/52

[58] Field of Search ..... 15/29, 24, 28, 15/23, 97.1, 50.1, 98, 49.1, 52; 451/359, 353

[56] References Cited

U.S. PATENT DOCUMENTS

| | | |
|---|---|---|
| D. 334,095 | 3/1993 | Beets et al. . |
| 773,436 | 10/1904 | Tangerman . |
| 2,854,829 | 10/1958 | Porter . |
| 2,993,311 | 7/1961 | West . |
| 3,526,916 | 9/1970 | Thomas et al. . |
| 4,151,624 | 5/1979 | Montalvo . |
| 4,208,753 | 6/1980 | Lewis . |
| 4,250,587 | 2/1981 | Beck, Jr. . |
| 4,417,826 | 11/1983 | Floros . |
| 4,513,466 | 4/1985 | Keddie et al. . |
| 4,780,992 | 11/1988 | McKervey . |
| 4,819,293 | 4/1989 | Nicholson . |

*Primary Examiner*—Robert Warden
*Assistant Examiner*—Jennifer C. McNeil
*Attorney, Agent, or Firm*—Stephen R. Greiner

[57] ABSTRACT

A scrubber including a longitudinal support having opposed, upper and lower ends. A handgrip is secured to the upper end of the longitudinal support, and a motor is secured to the lower end of the longitudinal support. The motor has an articulating drive shaft extending therefrom. A cleaning pad is secured to the bottom of the drive shaft. A housing encloses the drive shaft. The housing includes relatively articulating, lower and upper portions spaced from the drive shaft. The lower portion is secured to the top of the cleaning pad so as to rotate therewith. The upper portion is secured to the lower end of the longitudinal support so as to remain stationary as the drive shaft, cleaning pad and lower portion of the housing are rotated by the motor. A liquid reservoir, in selective fluid communication with the cleaning pad, is secured to the longitudinal support.

18 Claims, 1 Drawing Sheet

SCRUBBER

FIELD OF THE INVENTION

The present invention relates generally to brushing, scrubbing and general cleaning and, particularly, to a brush having a handle-mounted rotary disk.

BACKGROUND OF THE INVENTION

Cleaning bathrooms has never been a pleasant task. Particularly bothersome to many individuals is the scrubbing of soap films from bathtubs and sinks which often requires a significant amount of physical labor performed in an uncomfortable, stooped position. A need presently exists, therefore, for a labor-saving device which will reduce the amount of work and time required by a user to scrub a bathtub, sink or other dirty surface.

SUMMARY OF THE INVENTION

It is a principal object of the invention to provide a motor-powered scrubber for reducing the physical exertion and time required for many cleaning chores. The scrubber in accordance with the present invention features a longitudinal support having a handgrip secured to its upper end and a motor secured to its lower end. The motor has an articulating drive shaft which permits an attached cleaning pad to pivot and readily engage irregularly contoured and hard-to-reach surfaces.

The inventive scrubber also features a housing which encloses the drive shaft and isolates a user from an associated universal joint. The housing includes relatively articulating, lower and upper portions spaced from the drive shaft. The lower portion is secured to the top of the cleaning pad so as to rotate therewith. The upper portion is secured to the lower end of the longitudinal support so as to remain stationary as the drive shaft, cleaning pad and lower portion of the housing are rotated by the motor.

The scrubber further features a liquid reservoir circumferentially positioned about the longitudinal support to reduce the size of the scrubber. A conduit is positioned between the reservoir and the housing for placing the reservoir and the housing in fluid communication. A valve assembly, in fluid communication with the conduit, permits a user to control liquid flow from the reservoir to the housing. As the lower portion of the housing is preferably in fluid communication with the cleaning pad, liquid cleaning and rinsing agents can be easily applied to a surface through the pad as scrubbing is being performed.

It is an object of the invention to provide improved elements and arrangements thereof in a scrubber which is lightweight in construction, inexpensive in manufacture, and effective in use.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 2:
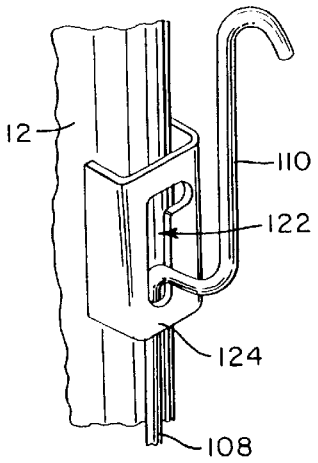
FIG. 2 is an enlarged perspective view of the upper portion of the valve assembly of the scrubber of FIG. 1.
Figure 3:
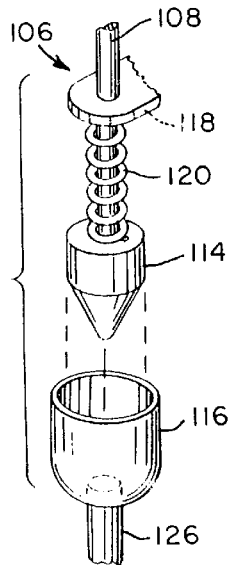
FIG. 3 is an enlarged perspective view of the bottom portion of the valve assembly.
Figure 4:
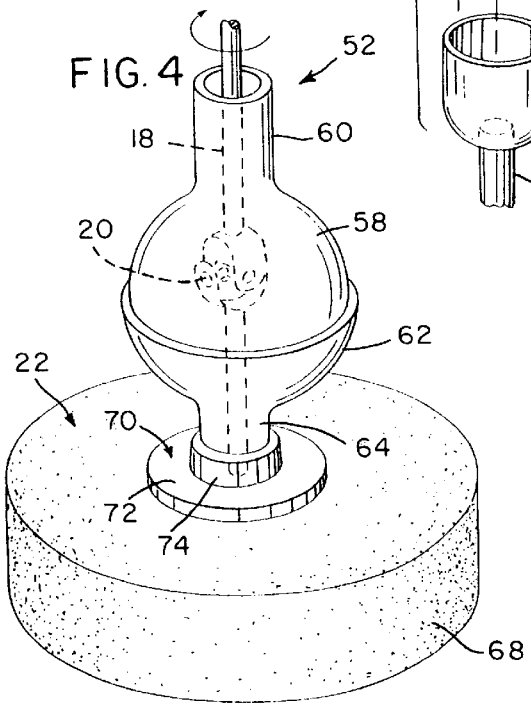
FIG. 4 is an enlarged perspective view of the bottom portion of the scrubber.
Figure 1:
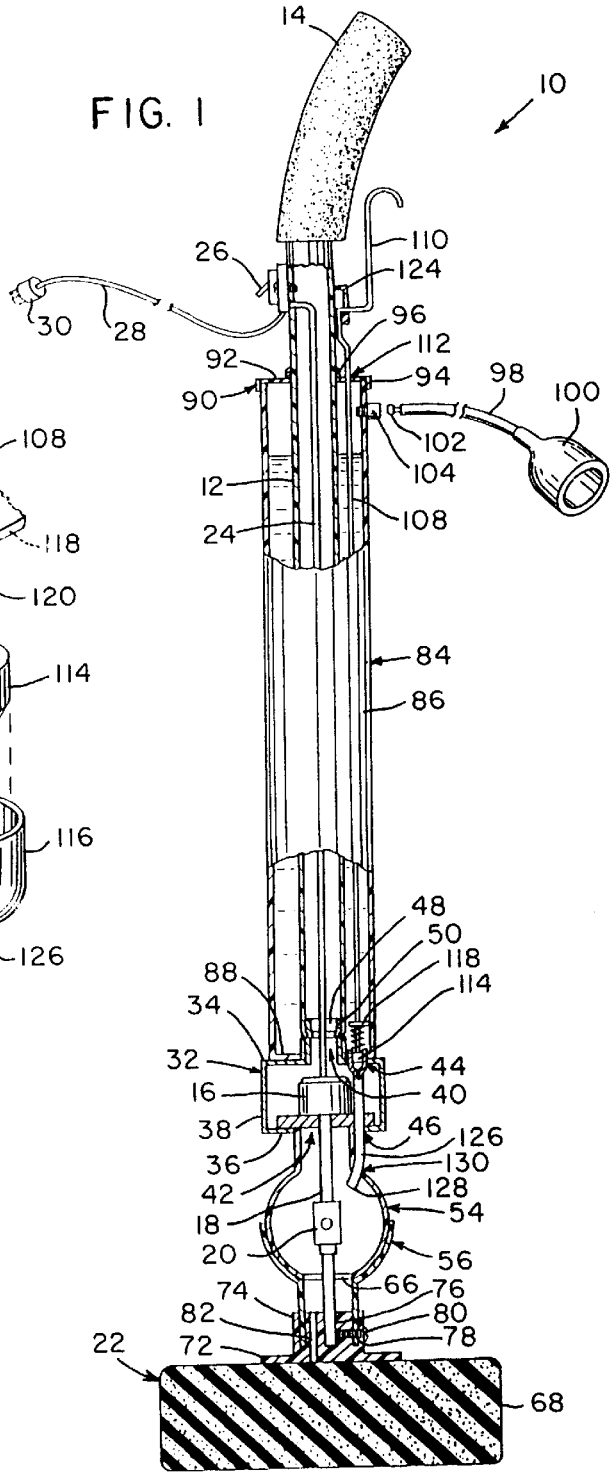
FIG. 1 is a side elevational view of a scrubber in accordance with the present invention with portions broken away to reveal details thereof.

Referring now to the FIGS., a scrubber in accordance with the present invention is shown at 10. The scrubber 10 includes a tubular, longitudinal support 12 having a handgrip 14 secured to its upper end and an electric motor 16 secured to its lower end. Extending downwardly from the motor 16 is a rotatable drive shaft 18 having a universal joint 20 at its midpoint to permit the bottom of the drive shaft to articulate. Affixed to the bottom of the drive shaft 18 is a circular cleaning pad 22.

Electrically conductive leads 24 extend upwardly from the motor and through the longitudinal support 12 to a switch 26 mounted on the support 12 adjacent the handgrip 14. Additional leads 28 extend from the switch 26 and terminate at a plug 30 for connection to a remote source of electrical current such as a conventional wall outlet (not shown). Manual manipulation of the switch 26 by a user selectively places the leads 24 and 28 in electrical communication to selectively energize the motor 16 and rotate the drive shaft 18.

The motor 16 is covered by a protective housing 32. As shown, the housing 32 includes a top wall 34 and a bottom wall 36 joined together by a circular side wall 38. The top and bottom walls 34 and 36 are provided with two pairs of opposed openings 40, 42 and 44, 46. A peripheral flange 48 surrounds the opening 40 and extends upwardly from the top wall 34 into the support 12 where such is secured by an interlocking feature 50 or other suitable means.

Like the motor 16, the drive shaft 18 is covered by a protective housing 52. The drive shaft housing 52 includes an upper "ball" portion 54 and a lower "socket" portion 56. The preferred upper portion 54 includes a hollow bulb 58 for enclosing the universal joint 20 and a tube 60 extending upwardly from the bulb 58 for enclosing the top portion of the drive shaft 18. The apex of the tube 60 is rigidly secured within the opening 42 in the bottom wall 36 of the motor housing 32. The lower portion 56, on the other hand, preferably includes a cup 62 adapted to snugly receive the bulb 58 and a tube 64 extending downwardly from the cup 62 for enclosing the bottom portion of the drive shaft 18. Articulation of the bottom portion of the drive shaft 18 is limited by the size of the opening 66 in the bottom of the bulb 58 to about twenty degrees from the position shown in the FIGS. where the top and bottom portions of the drive shaft are axially aligned.

The cleaning pad 22 preferably comprises a sponge disk 68 and a mounting bracket 70 for attachment of the disk 68 to the drive shaft 18 and lower portion 56 of the housing 52. The bracket 70 includes a backing plate 72 which is adhesively secured to the top of the disk 68. Extending upwardly from the plate 72 is a cylindrical plug 74 having a central bore 76 for receiving the bottom of the drive shaft 18 and a circular recess 78 around the bore 76 for receiving the tube 64 of the housing 52. The plug 74 and tube 64 are provided with lateral openings which may be aligned for threadably receiving a set screw 80. When threaded into place, the screw 80 engages the bottom portion of the drive shaft 18 and affixes it within the bore 76. Between the bore 76 and the circular recess 78, the plug 74 is provided with at least one liquid passageway 82 which extends through the backing plate 72.

Above the motor housing 32, the scrubber 10 is provided with a liquid reservoir 84. The reservoir 84 includes a cylindrical side wall 86 concentrically positioned about the support 12 and a circular bottom wall 88 for attaching the side wall 86 to the support 12. The top of the reservoir 84 is closed by a lid 90 which is slidably positioned on the support 12 below the switch 26. The lid 90 includes a circular top wall 92 and a downwardly-projecting peripheral flange 94 for snugly engaging the exterior of the reservoir side wall 86. A rubber retaining ring 96 is snugly positioned about the support 12 for selectively securing the lid 90 atop the side wall 86 so as to close the reservoir 84.

Filling the reservoir 84 may be accomplished by sliding the lid 90 upwardly from engagement with the side wall 86, pouring a quantity of liquid into the reservoir 84, and then replacing the lid. In the alternative, a continuous stream of liquid may be supplied to the reservoir 84 through a hose 98. The hose 98 is provided with a resilient fitting 100 at one of its ends for attachment to a faucet or other pressurized water source (not shown) and a male fastener 102 at the other end thereof. The male fastener 102 is adapted for mated engagement with a female fastener 104 mounted at the top of the reservoir side wall 86. Upon mating the fasteners 102 and 104, the interior of the reservoir 84 may be placed in fluid communication with the pressurized water source.

A valve assembly 106 is positioned largely within the reservoir 84 to permit the controlled flow of liquid therefrom. The valve assembly 106 includes an actuating rod 108 having a hook 110 formed at its upper end which extends through an opening 112 in the lid 90. The valve assembly 106 also includes a resilient stopper 114 secured to its lower end. As shown, the stopper 114 seats in a socket member 116 secured within the opening 44 in the bottom wall 88. A rod guide 118, secured to the side wall 86, retains the stopper 114 in alignment with the socket member 116. A compressed spring 120, positioned between the stopper 114 and the guide 118, normally retains the stopper in seated engagement with the socket member 116. Selective unseating of the stopper 114 from the socket member 116 may be accomplished by pulling the hook 110 upwardly (outwardly) from the lid 90.

The hook 110 is fitted within the L-shaped slot 122 of a retainer 124 which is secured to the support 12 adjacent the handgrip 14. The hook 110 may be selectively pulled against the tension of the spring 120 and then rotated into the relatively short horizontal leg of the slot to lock the valve assembly 106 in an open position whereby liquid may continuously flow from the reservoir 84. Of course, removing the hook 110 from the horizontal leg of the slot 122 permits the valve assembly 106 to close by means of the spring 120.

A liquid transfer conduit 126 is secured to the bottom of the socket member 116 and extends through opening 46 in the bottom wall of the motor housing 32. The bottom end 128 of the conduit 126 enters the drive shaft housing 52 through a hole 130 in the bulb 58 and terminates adjacent the universal joint 20. Liquid passing through the bottom end 128 of the conduit 126 is free to travel to the liquid passageway 82 and then to permeate into, and through, the sponge disk 68.

Use of the scrubber 10 is as uncomplicated as its construction. The plug 30 is first connected to a source of electrical current and the switch 26 is placed in its "on" position to energize the motor 16. Energization of the motor 16 causes the drive shaft 18 and affixed cleaning pad 22 to rotate. While holding the handgrip 14, the rotating pad 22 is then lightly pressed against a surface to be cleaned such as a bathtub or shower stall (not shown). The relatively long length of the support 12 (preferably about 35 inches) permits a user to clean in relative comfort without bending or stooping. The articulating action of the drive shaft 18 and shaft housing 52 permit the sponge disk 68 to remain in contact with the surface without requiring the user to maintain a fixed gripping position relative to the scrubber 10.

If it is desired to apply a soap, detergent or other cleaning liquid to the surface being cleaned while the pad 22 is being rotated, such may be easily accomplished by filling the reservoir 84 with the liquid prior to energizing the motor 16. As was explained above, the reservoir 84 may be filled with the hose 98 or by removing the lid 90 to add a quantity of liquid thereto. By pulling the hook 110, a user may subsequently release a liquid to the pad 22 as it is being rotated. If a pressurized liquid supply is close at hand, the hose 98 may be left in engagement with the water supply while the motor 16 rotates the pad 22 and the hook 110 is engaged with the short leg of the slot 122 to provide a continuous, "high-volume", flow of liquid to the surface being cleaned. The liquid flowing outwardly from the pad 22 serves to lift and rinse dirt from the surface being cleaned and flush the sponge disk 68 of dirt. Thus, the scrubber 10 is essentially self-cleaning.

While the invention has been described with a high degree of particularity, it will be appreciated by those skilled in the art that modifications may be made thereto. For example, the reservoir 84 may be positioned in any convenient location upon the support 12. Therefore, it is to be understood that the present invention is not limited to the sole embodiment described above, but encompasses any and all embodiments within the scope of the following claims.

I claim:

1. A scrubber, comprising:

a longitudinal support having opposed, upper and lower ends;

a handgrip secured to said upper end of said longitudinal support;

a motor secured to said lower end of said longitudinal support, said motor having an articulating drive shaft extending therefrom to a distal end;

a cleaning pad secured to the distal end of said drive shaft; and, a housing enclosing said drive shaft, said housing including relatively articulating, lower and upper portions spaced from said drive shaft, said lower portion being secured to the top of said cleaning pad so as to rotate therewith, and said upper portion being secured to said lower end of said longitudinal support.

2. The scrubber according to claim 1 wherein said motor is powered by electricity and includes electrical leads extending therefrom, said leads also extending through said longitudinal support.

3. The scrubber according to claim 1 wherein said articulating drive shaft includes a universal joint at a fixed point along its length.

4. The scrubber according to claim 1 wherein said lower portion has a cup secured to the top of said cleaning pad, said upper portion has a bulb secured to the lower end of said longitudinal support, and said bulb is slidably positioned within said cup.

5. The scrubber according to claim 1 wherein said housing is in fluid communication with said cleaning pad and said scrubber further comprises:

a liquid reservoir secured to said longitudinal support between said upper and lower ends;

a conduit positioned between said liquid reservoir and said housing for placing said liquid reservoir and said housing in fluid communication; and, a valve assembly in fluid communication with said conduit for controlling liquid flow from said liquid reservoir to said housing.

6. The scrubber according to claim 5 further comprising a hose secured to said liquid reservoir for connecting said liquid reservoir to a pressurized liquid source.

7. The scrubber according to claim 5 wherein said valve assembly includes:

a socket member positioned within said liquid reservoir and secured to the top of said conduit, said socket member having an opening in the bottom thereof in fluid communication with said conduit;

a stopper removably positioned within said socket member, said stopper being adapted to selectively close said opening in said socket member;

a rod guide secured within said liquid reservoir, said rod guide having an opening positioned adjacent said socket member;

an actuating rod slidably positioned within said opening in said rod guide, said actuating rod having one of its ends secured to said stopper and the other end thereof extending outwardly from said liquid reservoir; and, a compressed spring positioned on said actuating rod and extending between said stopper and said rod guide for normally biasing said stopper within said socket member so as to close said opening.

8. The scrubber according to claim 5 wherein said liquid reservoir is circumferentially positioned about said longitudinal support.

9. The scrubber according to claim 8 wherein said liquid reservoir includes a lid for allowing liquid to be added thereto, and said lid being slidably positioned upon said longitudinal support.

10. A scrubber, comprising:

a longitudinal support having opposed, upper and lower ends;

a handgrip secured to said upper end of said longitudinal support;

an electric motor secured to said lower end of said longitudinal support, said electric motor having an articulating drive shaft extending therefrom to a distal end;

a cleaning pad secured to the distal end of said drive shaft;

a housing enclosing said drive shaft, said housing including relatively articulating, lower and upper portions spaced from said drive shaft, said lower portion having a cup secured to the top of said cleaning pad so as to rotate therewith, said upper portion having a bulb rigidly secured to said lower end of said longitudinal support, said bulb being slidably positioned within said cup, and said cup being in fluid communication with said cleaning pad;

a liquid reservoir secured to said longitudinal support between said upper and lower ends;

a conduit positioned between said liquid reservoir and said bulb for placing said liquid reservoir and said housing in fluid communication; and, a valve assembly within said conduit for controlling liquid flow from said liquid reservoir to said housing.

11. The scrubber according to claim 10 wherein said articulating drive shaft includes a universal joint at a fixed point along its length.

12. The scrubber according to claim 10 further comprising a hose removably secured to said liquid reservoir for connecting said liquid reservoir to a pressurized liquid source.

13. The scrubber according to claim 10 wherein said valve assembly includes:

a socket member secured to the top of said conduit, said socket member having an opening in the bottom thereof in fluid communication with said conduit;

a stopper removably positioned within said socket member, said stopper being adapted to selectively close said opening in said socket member;

a rod guide secured within said liquid reservoir, said rod guide having an opening positioned adjacent said socket member;

an actuating rod slidably positioned within said opening in said rod guide, said actuating rod having one of its ends secured to said stopper and the other end thereof extending outwardly from said liquid reservoir; and, a compressed spring positioned on said actuating rod and extending between said stopper and said rod guide for normally biasing said stopper within said socket member so as to close said opening.

14. The scrubber according to claim 10 wherein said liquid reservoir is circumferentially positioned about said longitudinal support.

15. The scrubber according to claim 14 wherein said liquid reservoir includes a lid for allowing liquid to be added thereto, and said lid being slidably positioned upon said longitudinal support.

16. A scrubber, comprising:

a longitudinal support having opposed, upper and lower ends;

a handgrip secured to said upper end of said longitudinal support;

an electric motor secured to said lower end of said longitudinal support, said electric motor having an articulating drive shaft extending therefrom, said drive shaft having a universal joint for providing articulation thereof;

a cleaning pad secured to the bottom of said drive shaft;

a housing enclosing said drive shaft, said housing including relatively articulating, lower and upper portions spaced from said drive shaft, said lower portion having a cup secured to the top of said cleaning pad so as to rotate therewith, said upper portion having a bulb rigidly secured to said lower end of said longitudinal support, said bulb being slidably positioned within said cup, and said cup being in fluid communication with said cleaning pad;

a liquid reservoir secured to said longitudinal support between said upper and lower ends thereof, said liquid reservoir being circumferentially positioned about said longitudinal support;

a hose removably secured to said liquid reservoir for connecting said liquid reservoir to a pressurized liquid source;

a conduit positioned between said liquid reservoir and said bulb for placing said liquid reservoir and said housing in fluid communication; and, a valve assembly in fluid communication with said conduit for controlling liquid flow from said liquid reservoir to said housing.

17. The scrubber according to claim 16 wherein said valve assembly includes:

a socket member secured to the top of said conduit, said socket member having an opening in the bottom thereof in fluid communication with said conduit;

a stopper removably positioned within said socket member, said stopper being adapted to selectively close said opening in said socket member;

a rod guide secured within said liquid reservoir, said rod guide having an opening positioned adjacent said socket member;

an actuating rod slidably positioned within said opening in said rod guide, said actuating rod having one of its ends secured to said stopper and the other end thereof extending outwardly from said liquid reservoir; and, a compressed spring positioned on said actuating rod and extending between said stopper and said rod guide for biasing said stopper within said socket member so as to close said opening.

18. The scrubber according to claim 16 wherein said liquid reservoir includes a lid for allowing liquid to be added thereto, and said lid being slidably positioned upon said longitudinal support.

* * * * *